US006641181B2

(12) United States Patent
Thomas et al.

(10) Patent No.: US 6,641,181 B2
(45) **Date of Patent: *Nov. 4, 2003**

(54) AUTOMATIC KNOT-TYING MACHINE

(75) Inventors: Jay Dee Thomas, Charlotte, NC (US); Ralph S. Jenkins, Gastonia, NC (US)

(73) Assignee: Belmont Textile Machinery Co., Inc., Mount Holly, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/192,063

(22) Filed: Jul. 10, 2002

(65) Prior Publication Data

US 2002/0171245 A1 Nov. 21, 2002

Related U.S. Application Data

(63) Continuation of application No. 09/982,041, filed on Oct. 18, 2001, now Pat. No. 6,419,283.
(60) Provisional application No. 60/242,785, filed on Oct. 24, 2000.

(51) Int. Cl.[7] ..... A01D 59/04

(52) U.S. Cl. ..... 289/2; 289/1.2; 289/1.5
(58) Field of Search ..... 289/1.2, 1.5, 2, 289/6, 12, 18.1; 57/1 R, 266, 281; 242/475.1, 475.4, 475.6, 475.7, 475.8, 476, 164

(56) References Cited

U.S. PATENT DOCUMENTS

| | | | | | |
|---|---|---|---|---|---|
| 3,595,491 | A | * | 7/1971 | Bourque | 242/475.7 |
| 3,652,025 | A | * | 3/1972 | DiMauro | 242/476 |
| 3,838,875 | A | * | 10/1974 | Franzen | 289/18.1 |
| 4,084,767 | A | * | 4/1978 | Witt | 242/164 |
| 4,157,063 | A | * | 6/1979 | Minke | 100/3 |
| 4,351,551 | A | * | 9/1982 | Verhulst | 289/2 |
| 4,437,617 | A | * | 3/1984 | Cardell | 242/475.7 |
| 4,630,782 | A | * | 12/1986 | Rohner | 242/475.7 |
| 4,765,235 | A | * | 8/1988 | Schrag et al. | 100/3 |
| 4,796,422 | A | * | 1/1989 | Odawara | 57/299 |
| 4,836,587 | A | * | 6/1989 | Hinzmann | 289/2 |
| 4,848,077 | A | * | 7/1989 | Kawarabashi et al. | 57/281 |
| 4,909,451 | A | * | 3/1990 | Kuepper et al. | 242/475.8 |
| 5,082,192 | A | * | 1/1992 | Langen et al. | 242/470 |
| 5,104,052 | A | * | 4/1992 | Wey et al. | 242/475.8 |
| 5,106,027 | A | * | 4/1992 | Wirtz et al. | 242/475.8 |
| 5,131,437 | A | * | 7/1992 | Shaw et al. | 139/450 |
| 5,168,789 | A | * | 12/1992 | Suzuki | 87/6 |
| 5,236,232 | A | * | 8/1993 | Broberg | 289/1.5 |

(List continued on next page.)

FOREIGN PATENT DOCUMENTS

| | | | |
|---|---|---|---|
| BE | 746148 | * | 8/1970 |
| JP | 40-13706 | * | 7/1965 |

*Primary Examiner*—Gary L. Welch
(74) *Attorney, Agent, or Firm*—Adams Evans P.A.

(57) ABSTRACT

A knot-tying machine, including a package support for holding a package having a supply of a strand material with an exposed free end wound onto an outer surface of the package, a strand gripper for releasably gripping and holding a length of the strand adjacent the exposed free end of the strand, a loop-forming assembly for forming a loop in the length of the strand adjacent the exposed free end of the strand and intermediate the gripper and the package, the package support and the loop-forming assembly mounted for rotational movement relative to each other for forming the loop in the strand, and a knot-forming assembly for forming a slip-knot in the loop of the strand formed by the loop-forming assembly adjacent the free end thereof, the slip-knot being adapted to be subsequently removed when desired by pulling on the free end of the strand. The package support may be stationarily mounted and the loop-forming assembly mounted for rotation around the periphery of the package support for capturing the length of the strand adjacent the exposed free end of the strand for forming a loop therein.

15 Claims, 13 Drawing Sheets

U.S. PATENT DOCUMENTS 5,435,862 A * 7/1995 Williams et al. ..... 156/64
5,540,795 A * 7/1996 Franklin et al. ..... 156/64
5,553,798 A * 9/1996 Kobayashi et al. ..... 242/475.8
D376,013 S * 11/1996 Sandman et al. ..... D24/169
5,575,762 A * 11/1996 Peeler et al. ..... 601/152
5,588,954 A * 12/1996 Ribando et al. ..... 601/149
5,653,719 A * 8/1997 Raiken ..... 606/148
5,829,706 A * 11/1998 Schatton et al. ..... 242/475.4
6,042,044 A * 3/2000 Gorke et al. ..... 242/474.5
6,080,120 A * 6/2000 Sandman et al. ..... 601/152
6,419,283 B1 * 7/2002 Thomas et al. ..... 289/2

* cited by examiner

AUTOMATIC KNOT-TYING MACHINE

This application is a continuation of patent application Ser. No. 09/982,041, filed Oct. 18, 2001, now U.S. Pat. No. 6,419,283, which claims the benefit of Provisional Application Serial No. 60/242,785, Filed Oct. 24, 2000.

TECHNICAL FIELD AND BACKGROUND OF THE INVENTION

This application is based on and claims priority from provisional application Serial No. 60/242,785, filed Oct. 24, 2000.

This invention relates to an automatic knot-tying machine, otherwise referred to in this application as a "package knotter." One application for the machine is for use in various textile or other strand producing processes, hereinafter referred to as "textile" processes. The invention is specifically intended to tie a slip knot in a single strand. Many textile machines, for example, spinning frames, winders and the like employ automated machines to tie two yarn ends together. This often happens when supply packages are exchanged. In effect, tying the two ends together permits the process to continue as if the yarn were a single continuous strand instead of two end-to-end strands connected together with a knot. As is apparent, the principal criteria for such a knot-tying machine is to quickly tie a knot which will not come untied and which is sufficiently strong to withstand the various stresses and tensions placed on the yarn during downstream processing.

This invention is distinctly different from machines and processes which tie together yarns or other strand material ("yarn") end-to-end. Rather, a slip-knot is tied in the single free end of yarn on, for example, the outer surface of a wound package of yarn. The purpose of the knot is to prevent the package from beginning to unwind during doffing, transportation, storage and donning onto downstream machines. The slip-knot is easily untied simply by pulling the free end of the yarn.

Most prior art ways of preventing yarn from unwinding from a package involve using a short length of tape to adhere the free end to the outer surface of the package, or catching the yarn in a notch or slit in the end of the tube on which the yarn is wound.

In another prior art method, the free end of yarn is doubled and then forced through the edge of the outer surface of yarn by a long needle, so that some of the outermost wraps of yarn hold the doubled length of yarn in place. The end is freed by pulling on the free end. This process presents the possibility of damage to the yarn by the needle or tangling of the doubled yarn, particularly if it is pushed too far into the package.

SUMMARY OF THE INVENTION

Therefore, it is an object of the invention to provide a knot-tying machine which ties an easily-removable slip-knot in a strand.

It is another object of the invention to provide a knot-tying machine which ties an easily-removable slip-knot in a yarn end.

It is another object of the invention to provide a knot-tying machine which ties an easily-removable slip-knot in a yarn end on a textile yarn package.

It is another object of the invention to provide a knot-tying machine which automatically ties an easily-removable slip-knot in a yarn end on a textile yarn package as an integral function of a yarn package doffing step.

It is another object of the invention to provide a knot-tying machine which automatically ties an easily-removable slip-knot in a yarn end on a textile yarn package as an integral function of a yarn package doffing step, wherein the free end of the knotted yarn is always located in the same position across the width of the yarn package.

It is another object of the invention to provide a knot-tying machine which ties an easily-removable slip-knot in a yarn end on a textile yarn package, wherein the free end is adapted to be grasped and pulled to release the knot manually or automatically.

It is another object of the invention to provide a knot-tying machine which includes means for retaining an entire case of yarn packages at a processing machine and sending the entire case of yarn to the packing station at the same time.

It is another object of the invention to provide a knot-tying machine for use in combination with a textile winding machine, wherein multiple packages of yarn are doffed at the same time, conveyed one at a time to a knot-tying machine where a slip knot is tied in the yarn end of the yarn on the package.

It is another object of the invention to provide a knot-tying machine for use in combination with a textile winding machine or any other machine, wherein multiple packages of yarn are doffed at the same time or in any sequence and conveyed one at a time to a knot-tying machine where a slip knot in the yarn end of the yarn on the package, and further wherein a label is then automatically inserted into the package.

It is another object of the invention to provide a knot-tying machine which doffs an entire winder at the same time and then conveys the packages to a knot-tying station where the yarn end of each package is tied one at a time.

These and other objects of the present invention are achieved in the preferred embodiments disclosed below by providing a knot-tying machine, comprising a package support for holding a package having a supply of a strand material with an exposed free end wound onto an outer surface of the package, a strand gripper for releasably gripping and holding a length of the strand adjacent the exposed free end of the strand, a loop-forming assembly for forming a loop in the length of the strand adjacent the exposed free end of the strand and intermediate the gripper and the package, the package support and the loop-forming assembly mounted for rotational movement relative to each other for forming the loop in the strand, and a knot-forming assembly for forming a slip-knot in the loop of the strand formed by the loop-forming assembly adjacent the free end thereof, the slip-knot being adapted to be subsequently removed when desired by pulling on the free end of the strand.

According to one preferred embodiment of the invention, the package support is stationarily mounted and the loop-forming assembly is mounted for rotation around the periphery of the package support for capturing the length of the strand adjacent the exposed free end of the strand for forming a loop therein.

According to another preferred embodiment of the invention, the loop-forming assembly is stationarily mounted, the package support is mounted for rotation about an axis which is stationary relative to the loop-forming assembly, the gripper is mounted concentrically with the package support for rotation therewith, the knot-forming assembly is mounted for rotation relative to the loop formed by the loop-forming assembly for inserting the knot in the loop.

According to yet another preferred embodiment of the invention, the loop-forming assembly includes an elongate member movable between a retracted position, an extended position within the loop formed by the loop-forming assembly, and a secondary loop-forming position wherein the elongate member is mounted on a pivot for rotation to form a secondary loop in the loop. Further, the knot-forming assembly includes a strand capture assembly carried by the elongate member for capturing a length of the strand between the loop and the gripper and pulling the length of strand through the secondary loop to form the slip knot.

According to yet another preferred embodiment of the invention, the elongate member of the knot-tying assembly is mounted for rotation on an axis perpendicular to the axis of rotation of the package.

According to yet another preferred embodiment of the invention, the elongate member comprises a hollow tube, and wherein the strand capture assembly includes a hook movable between a retracted position within the elongate member and an extended position in a strand capture position relative to the strand.

According to yet another preferred embodiment of the invention, the invention includes a stationary yarn package support for holding a package having a supply of textile yarn wound thereon with an exposed free end residing on an outer surface of the package and a stationary yarn gripper for releasably gripping and holding a length of the yarn adjacent the exposed free end of the yarn. A loop-forming swing arm is provided for forming a loop in the length of the yarn adjacent the exposed free end of the yarn and intermediate the gripper and the package. The loop-forming swing arm is mounted for rotation about an axis parallel to a longitudinal axis of the package in spaced-apart relation to the outer surface of the package and intermediate the surface of the package and the yarn gripper for separating a length of yarn from the surface of the package. The loop-forming swing arm includes thereon an elongate member mounted on the loop-forming swing arm for twisting the length of yarn separated from the surface of the package and held by the gripper about an axis perpendicular to the axis of rotation of the loop-forming swing arm for forming a secondary loop therein. A knot-forming assembly is carried by the elongate member for capturing a second length of the yarn separated from the surface of the package and pulling the second length of yarn through the secondary loop and thus forming a slip-knot in the loop of the strand formed by the loop-forming assembly adjacent the free end thereof. The slip-knot is adapted to be subsequently removed when desired by pulling on the free end of the strand.

According to yet another preferred embodiment of the invention, the invention includes a textile winder having a plurality of winding stations for winding yarn onto yarn packages and a conveyor assembly for conveying yarn packages from the winding stations to the knot-tying machine.

According to yet another preferred embodiment of the invention, the invention includes second conveyor assembly for conveying yarn packages with the slip-knot formed thereon to a remote location for packaging.

An embodiment of the method according to the invention of tying a knot in a strand carried on a package comprises the steps of mounting a package having a supply of a strand material with an exposed free end wound onto an outer surface of the package, gripping and holding a length of the strand adjacent the exposed free end of the strand, forming a loop in the length of the strand adjacent the exposed free end of the strand and intermediate the gripper and the package by relative rotational movement of the package and a loop-forming assembly, and forming a slip-knot in the loop of the strand formed in the strand of a type adapted to be subsequently removed when desired by pulling on the free end of the strand.

According to yet another preferred embodiment of the invention, the step of forming the loop comprises the step of rotating a loop-forming assembly about an axis of rotation of the package in spaced-part relation thereto for capturing and separating a length of the strand from the surface of the package.

According to yet another preferred embodiment of the invention, the method includes the steps of mounting a loop-forming assembly in stationary relation to the package, mounting the package for rotation about an axis which is stationary relative to the loop-forming assembly, providing a gripper mounted concentrically with the package support for rotation therewith, and rotating the knot-forming assembly relative to the loop formed by the loop-forming assembly for inserting the knot in the loop.

According to yet another preferred embodiment of the invention, the step of forming the loop includes the steps of moving an elongate member movable between a retracted position, an extended position within the loop formed by the loop-forming assembly, a secondary loop-forming position wherein the elongate member is mounted on a pivot for rotation to form a secondary loop in the loop, providing a strand capture assembly carried by the elongate member and capturing a length of the strand between the loop and the gripper and pulling the length of strand through the secondary loop to form the slip knot.

According to yet another preferred embodiment of the invention, the method includes the step of mounting the elongate member of the knot-tying assembly for rotation on an axis perpendicular to the axis of rotation of the package.

According to yet another preferred embodiment of the invention, the elongate member comprises a hollow tube with a hook carried therein and movable between a retracted position within the hollow tube and an extended position in a strand capture position relative to the strand.

According to yet another preferred embodiment of the invention, the method comprises the steps of holding in a stationary position a package having a supply of textile yarn wound thereon with an exposed free end residing on an outer surface of the package, releasably gripping and holding a length of the yarn adjacent the exposed free end of the yarn, forming a loop in the length of the yarn adjacent the exposed free end of the yarn and intermediate the gripper and the package by rotation of a loop-forming swing arm about an axis parallel to a longitudinal axis of the package in spaced-apart relation to the outer surface of the package and intermediate the surface of the package and the gripped yarn, separating a length of yarn from the surface of the package, twisting the length of yarn separated from the surface of the package about an axis perpendicular to the axis of rotation of the loop-forming swing arm for forming a secondary loop therein, and capturing a second length of the yarn separated from the surface of the package and pulling the second length of yarn through the secondary loop and thus forming a slip-knot in the loop of the strand formed by the loop-forming assembly adjacent the free end thereof, the slip-knot being adapted to be subsequently removed when desired by pulling on the free end of the strand.

According to yet another preferred embodiment of the invention, the method includes the step of rotating the package in the wind direction sufficiently to pull the secondary loop tightly around the length of yarn pulled through the secondary loop.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
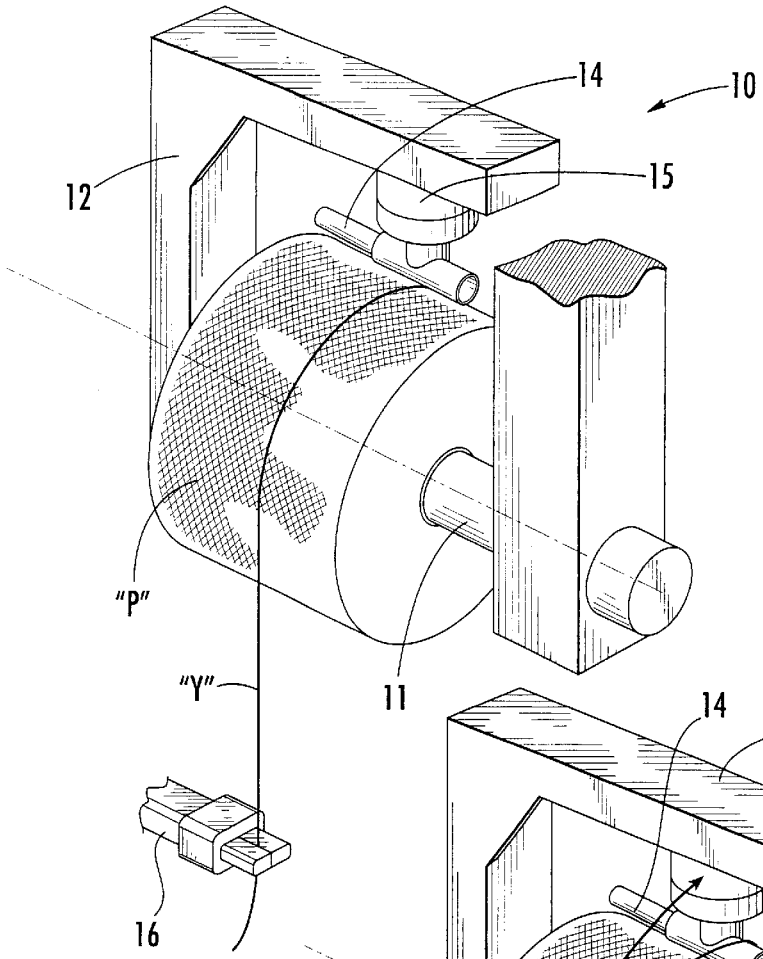
FIGS. 1–10 are sequential views of an automatic slip-knot tying machine according to one embodiment of the invention.
Figure 2:
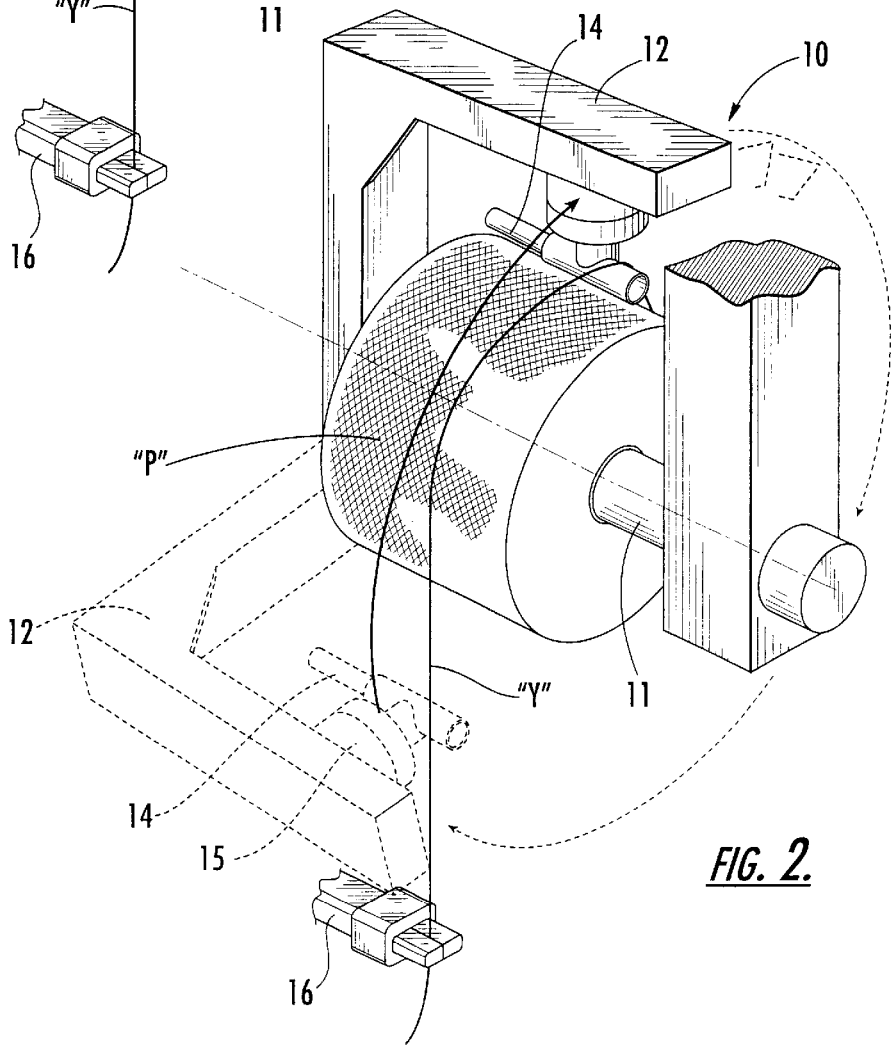

Referring now specifically to the drawings, an automatic knot-tying machine according to one embodiment of the present invention is illustrated in FIGS. 1–10 and shown generally at reference numeral 10. It is anticipated that automatic knot-tying machine 10 will be an attachment to textile winders and other machines where such knots are useful in preparing packages of yarn for transport to downstream processes. In one type of textile winder, packages are doffed from the individual winding stations and carried by a conveyer to one end of the machine, where the automatic knot-tying machine 10 finds the free end of the yarn "Y" and ties it into a slip knot in accordance with the invention disclosed herein.

The automatic knot-tying machine 10 includes a mandrel 11 on which the yarn package "P" is positioned. A swing arm 12 is positioned to rotate around the package "P", and carries a loop-forming tube 14. The mandrel 11 remains stationary. A gripper 16 holds the free end of the yarn "Y" taut during knot formation. From the starting position shown in FIG. 1, the swing arm 12 rotates around the package "P" and in so doing catches the yarn "Y" on the loop-forming tube 14. The loop-forming tube 14 is mounted for rotation around a vertical axis on a shaft 15.

When the swing arm reaches the twelve o'clock position again (FIG. 2), the yarn "Y" is looped around the package "P" and rests over the loop forming tube 14. Yarn to form the loop is unwound off of the package "P" during rotation of the swing arm 12.

Figure 3:
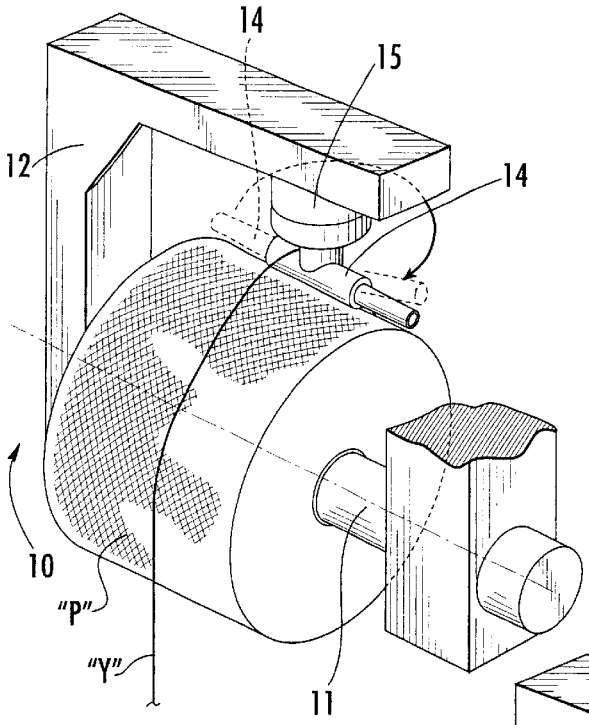
Figure 4:
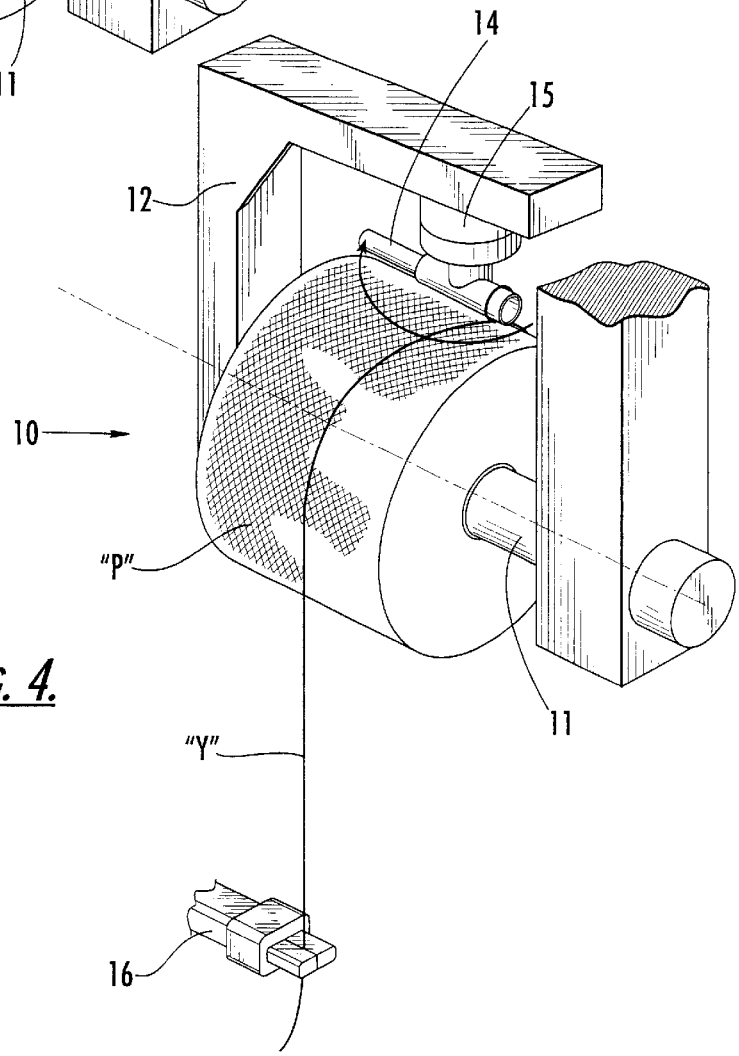

Referring now to FIGS. 3 and 4, shaft 15 is rotated 360 degrees to form a loop around the loop-forming tube 14 in the yarn "Y."

Figure 5:
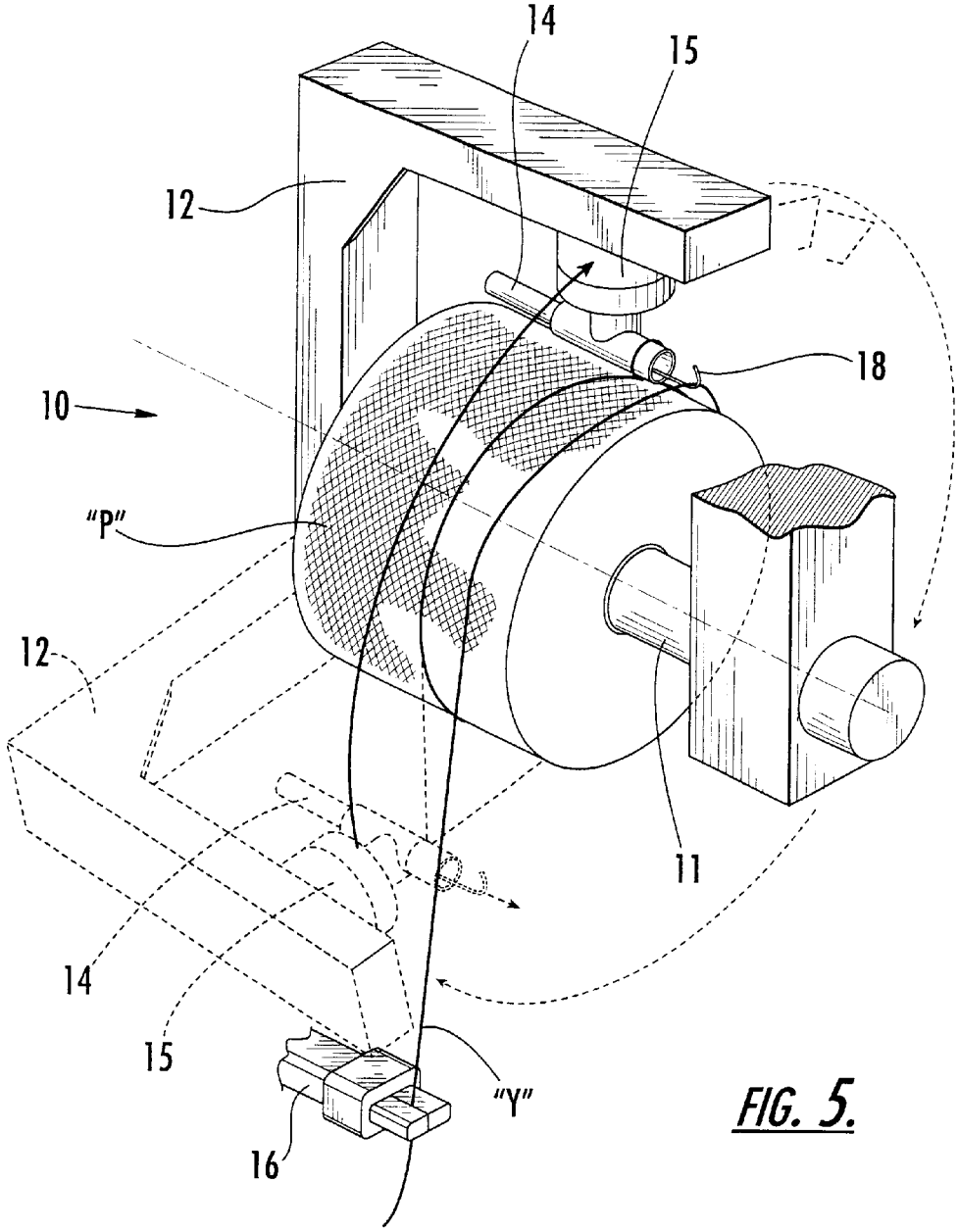
Figure 6:
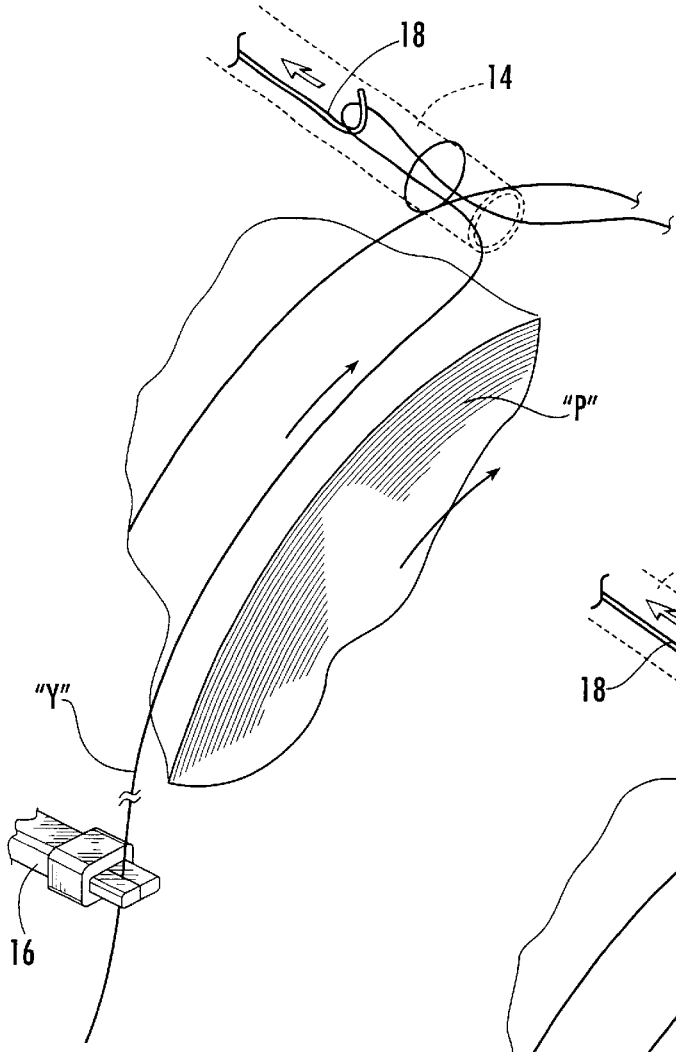
Figure 7:
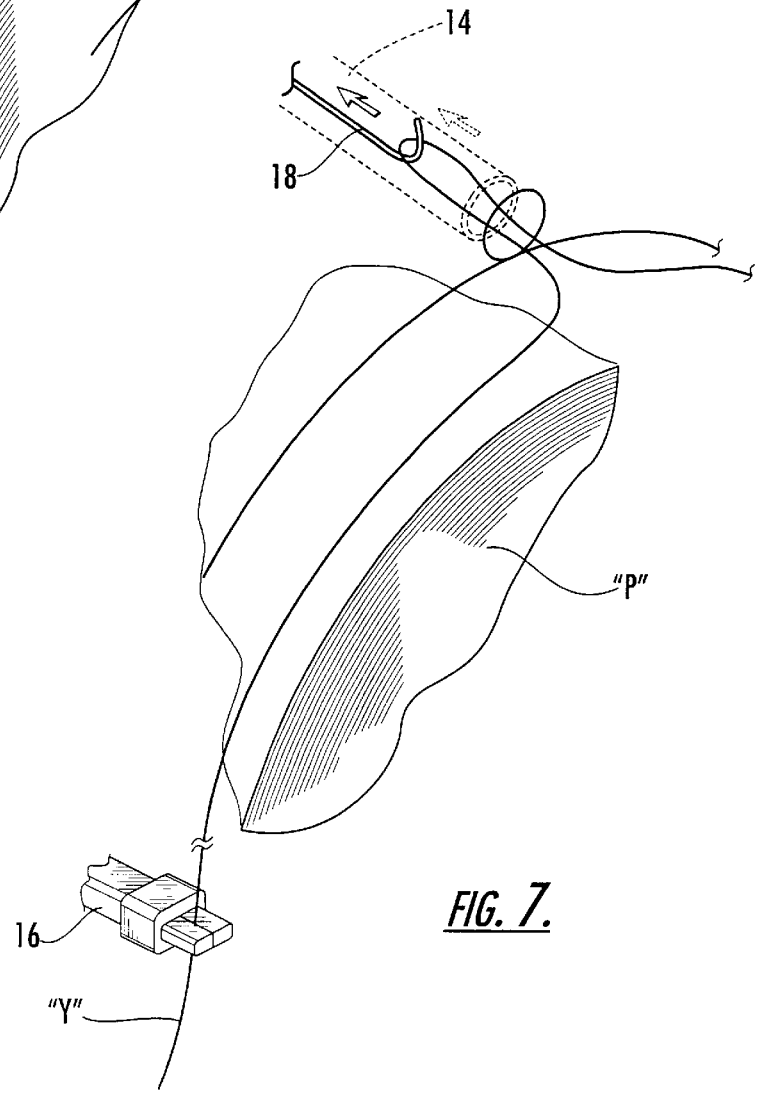

As is shown in FIG. 5, the swing arm 12 is rotated a further 360 degrees, while a hook 18 extends from the loop-forming tube 14 and catches the second pass of the yarn "Y." Note at this point the first loop formed by the swing arm 12 still resides over the loop-forming tube 14. As is shown in FIG. 6, the hook 18 is withdrawn into the loop-forming tube 14, whereupon the loop-forming tube 14 itself is retracted, allowing the first loop formed by the swing arm 12 to slide off the end of the loop-forming tube 14 and across the neck of the loop drawn into the loop-forming tube 14 by the hook 18. See FIG. 7. As is also shown in FIG. 6, the package "P" is rotated in the unwind direction to provide sufficient slack in the yarn "Y" to permit the yarn "Y" to be pulled into the loop-forming tube 14.

Figure 8:
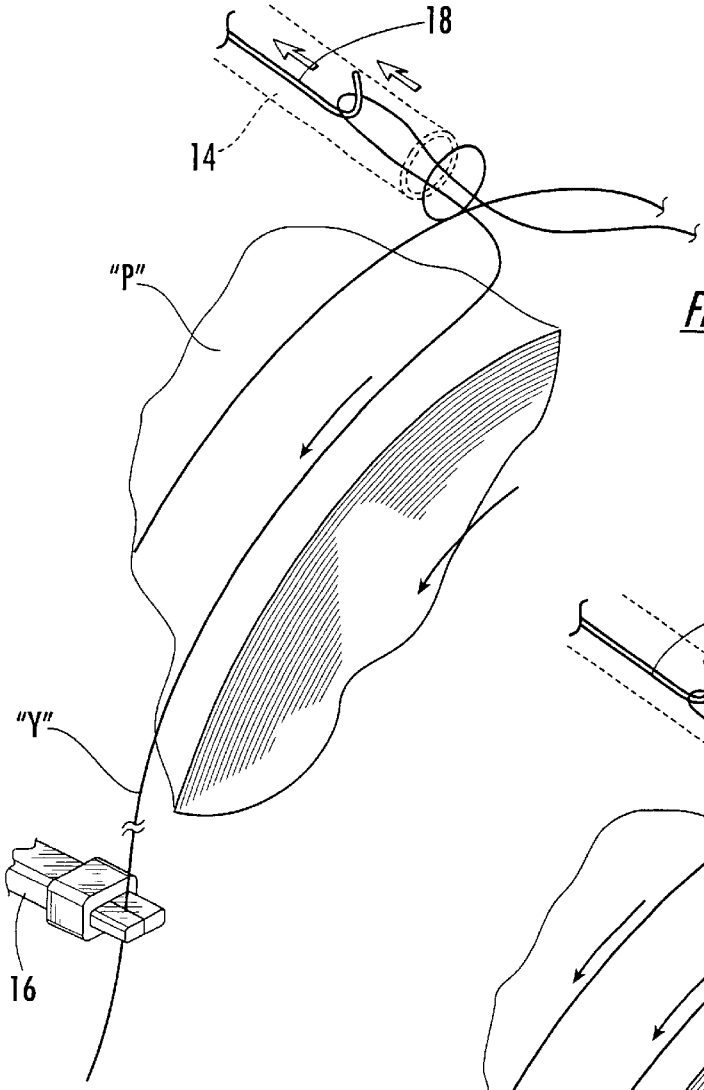
Figure 9:
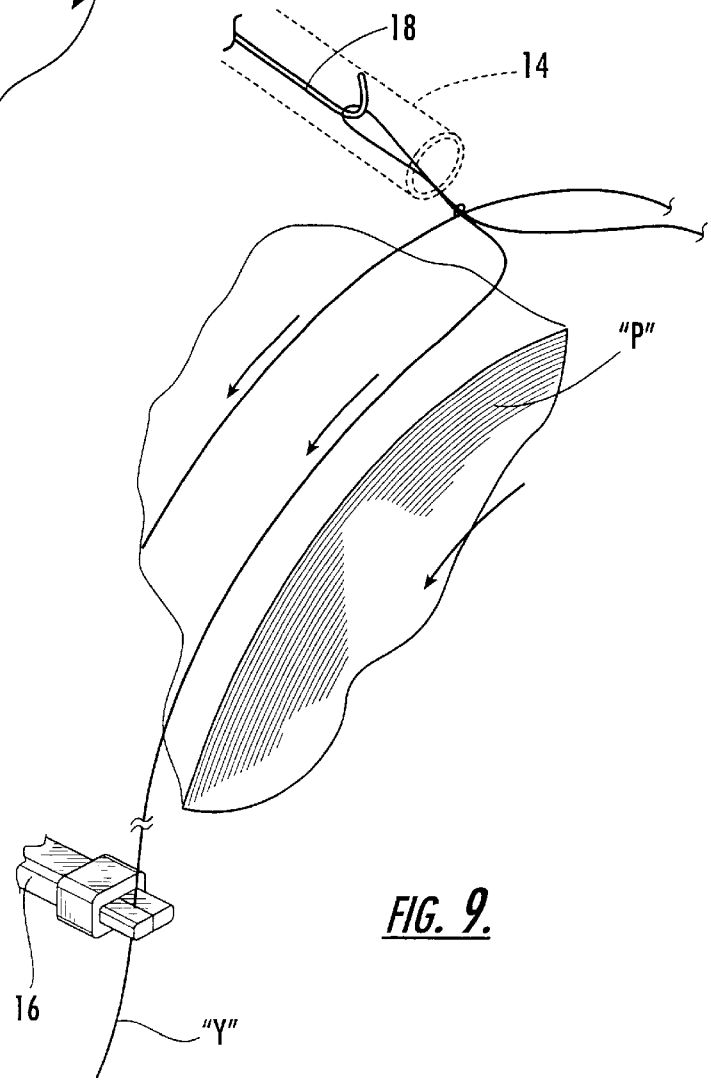
Figure 10:
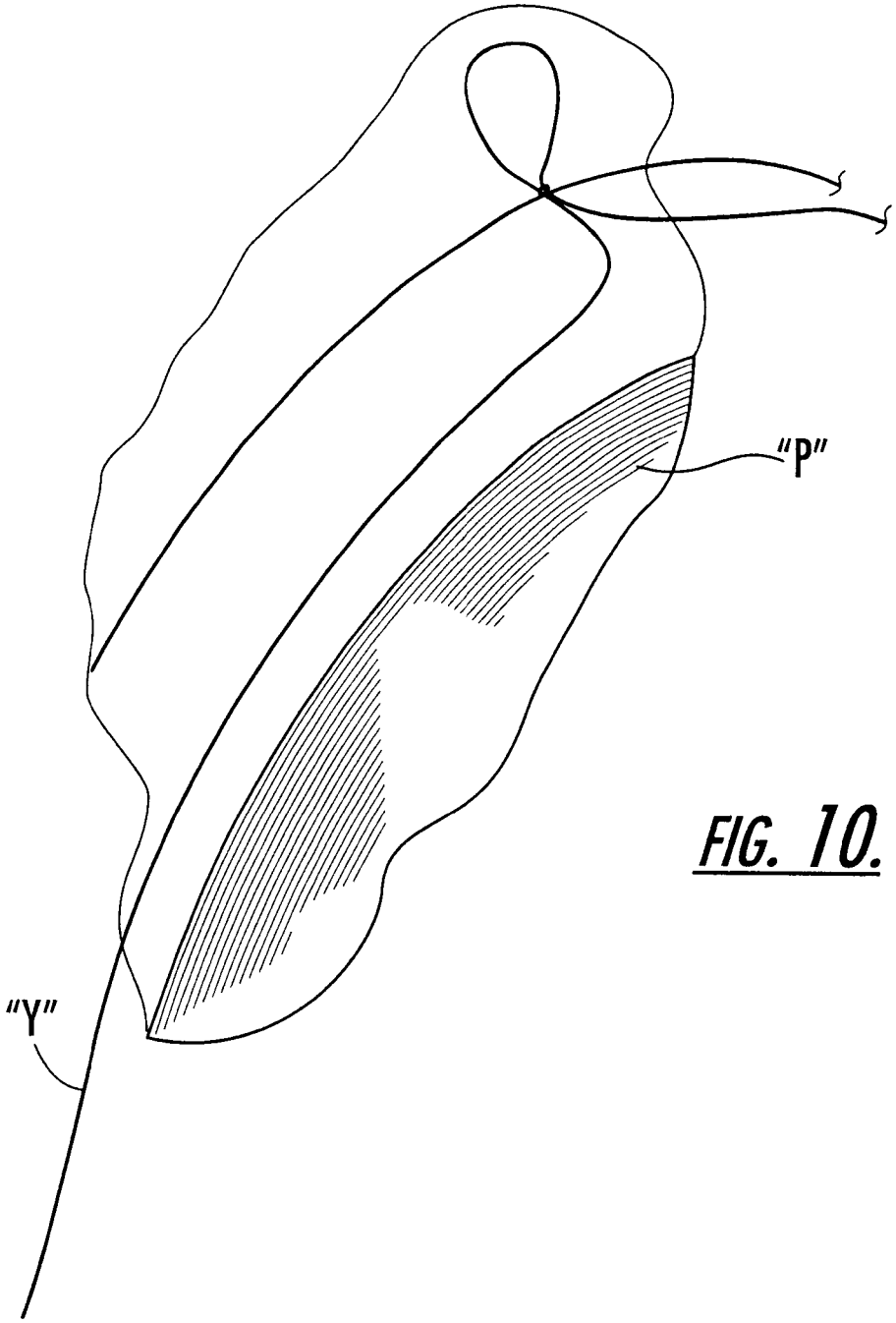
Figure 11:
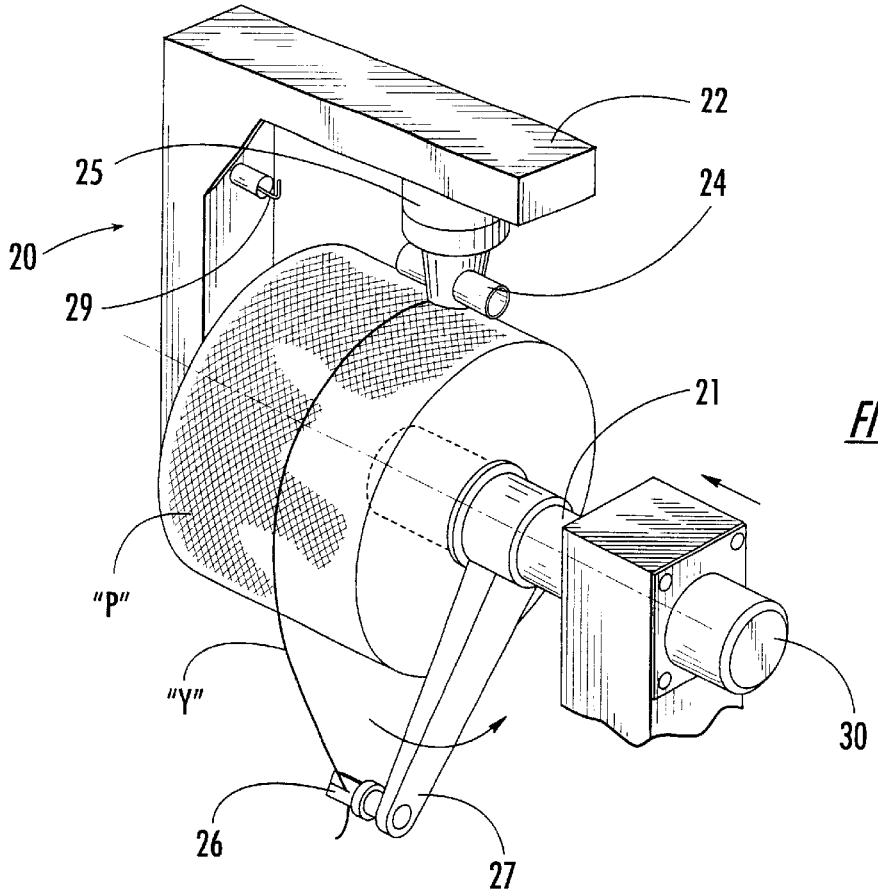
FIGS. 11–18 are sequential views of an automatic slip-knot tying machine according a second embodiment of the invention.

Referring now to FIGS. 8 and 9, the knot is tightened by rotating the package "P" in the wind direction sufficiently to pull the loop tight around the length of yarn "Y" being retained in the loop-forming tube 14 by the hook 18. The hook 18 releases the yarn "Y" by rotating about its axis and the slip-knot is fully formed. See FIG. 10. The package "P" is rotated sufficiently to snug the yarn "Y" around the outside of the package "P" and then transported away from the automatic knot-tying machine 10.

It should be noted that any number of different mechanisms can be used to pull the yarn "Y" into the loop-forming tube 14. The hook 18 shown in the drawings is simply illustrative of several iterations, including a latch needle or a gripper similar to the gripper 16. The functional principle resides in the need to grip the yarn and pull it through the loop formed on the loop-forming tube 14, and then to release the yarn "Y" at the appropriate time.

Another embodiment of the invention is shown in FIGS. 11–18, where an automatic knot-tying machine according to the present invention is illustrated and shown generally at reference numeral 20. As with automatic knot-tying machine 10, it is anticipated that automatic knot-tying machine 20 will be an attachment to textile winders and other machines where such knots are useful in preparing packages of yarn for transport to downstream processes.

The automatic knot-tying machine 20 includes a rotatable mandrel 21, such as an air chuck, on which the yarn package "P" is positioned. A stationary arm 22 is positioned adjacent the package "P", and carries a loop-forming tube 24. A gripper 26 mounted on the end of a rotating swing arm 27 holds the free end of yarn taut during knot formation. A servo-motor or motors 30 rotate both the swing arm 27 and the mandrel 21 on which the package "P" is positioned. From the starting position shown in FIG. 11, the swing arm 27 rotates around the package "P" and in so doing passes the yarn "Y" being held by the gripper onto the loop-forming tube 24. The loop-forming tube 24 is mounted for rotation around a vertical axis on a shaft 25.

Figure 12:
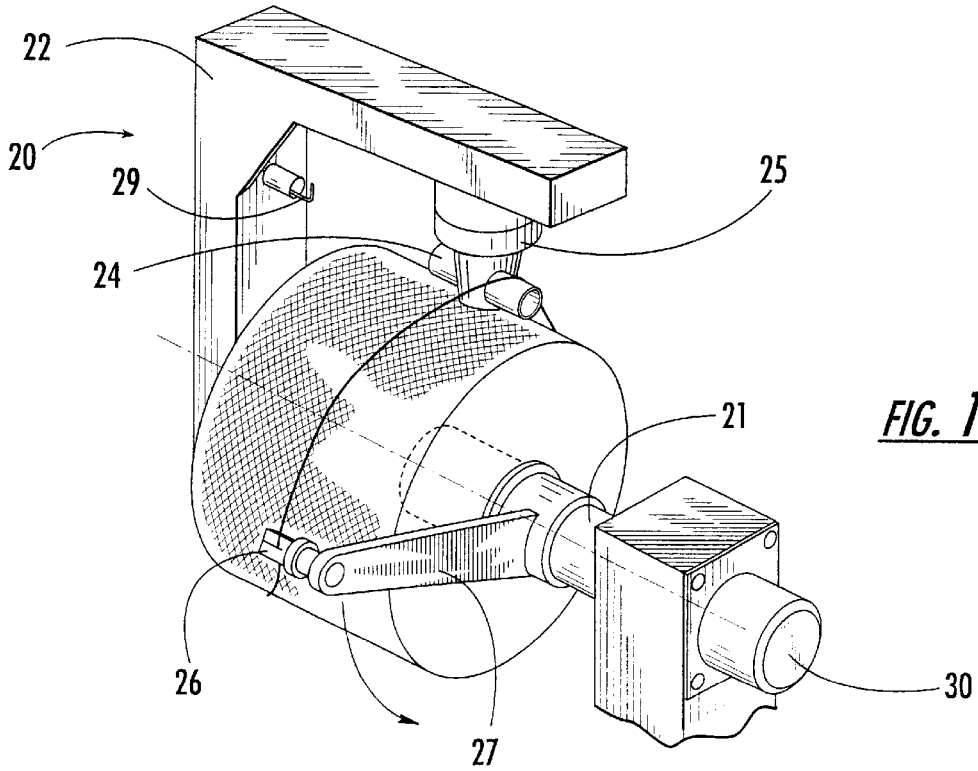

When the swing arm 27 reaches its starting position again the yarn "Y" is looped around the package "P" and rests over the loop forming tube 24. Yarn to form the loop is unwound off of the package "P" during rotation of the loop-forming tube 24. As is shown in FIG. 12, the package "P" and the swing arm rotate in the same direction during this step.

Figure 13:
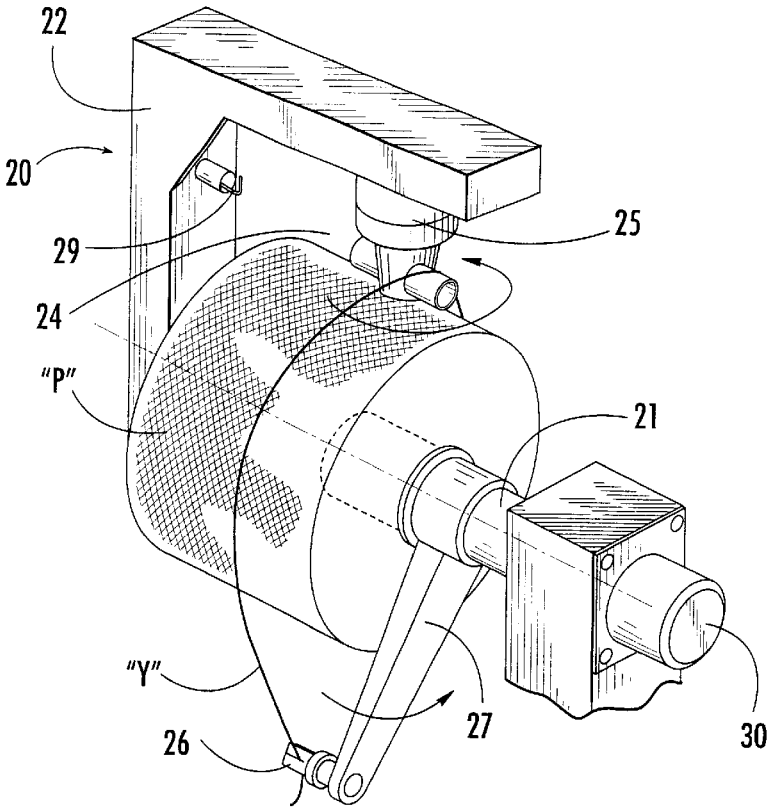
Figure 14:
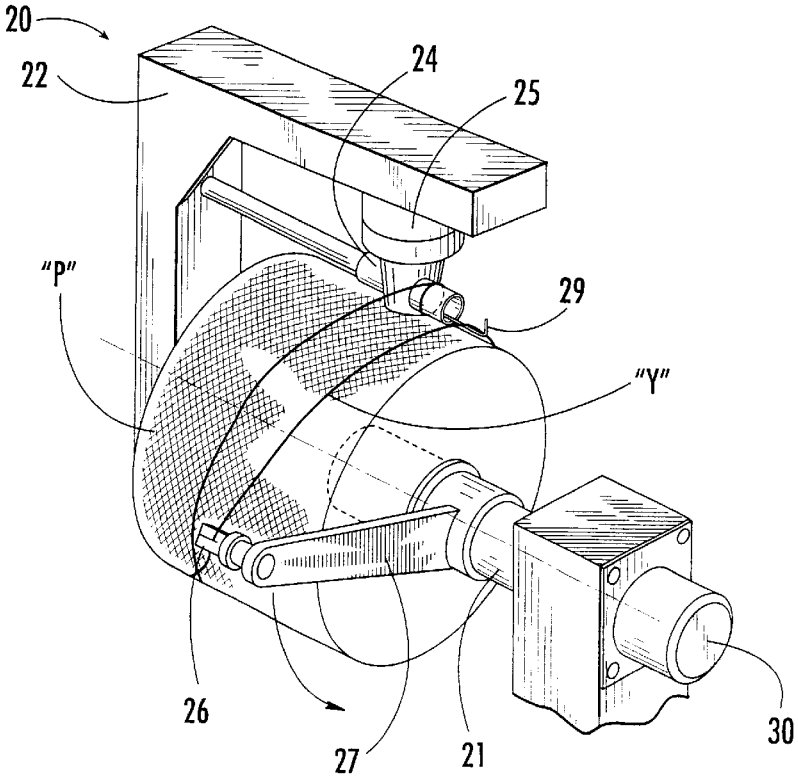

Referring now to FIGS. 13 and 14, shaft 25 is rotated 360 degrees to form a loop around the loop-forming tube 24 in the yarn "Y." A hook 29 carried by the stationary arm 22 extends outwardly into the loop-forming tube 24 and out the other end in preparation for a transfer to the hook.

Figure 15:
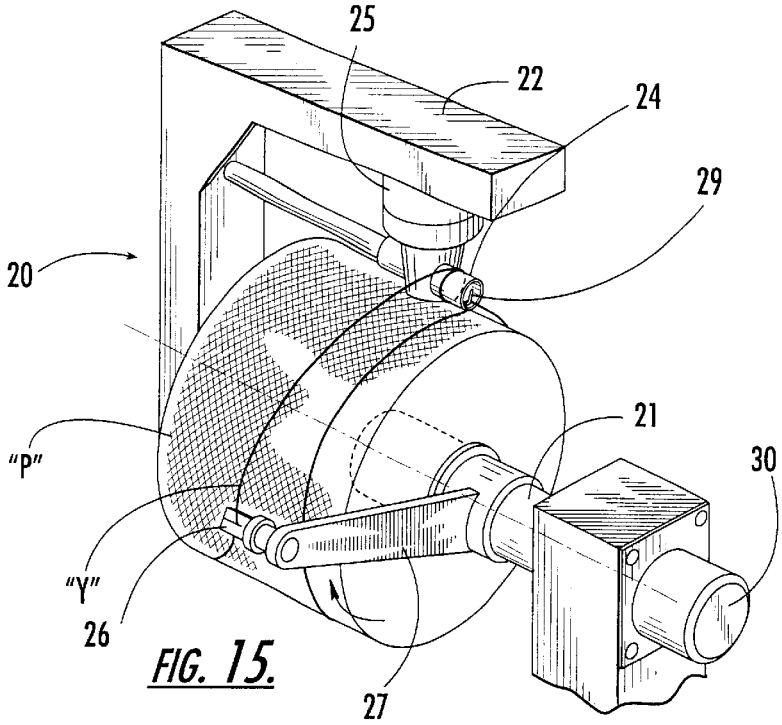
Figure 16:
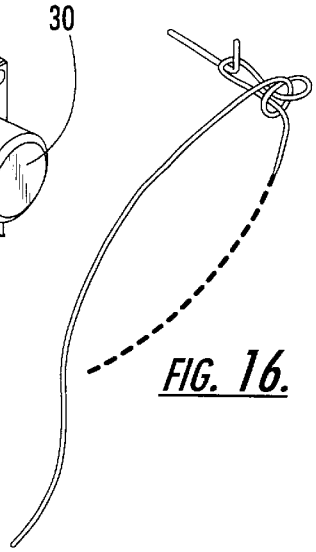

As is shown in FIGS. 14 and 15, the swing arm 27 is rotated a further 360 degrees, while the hook 29 extending outwardly from the loop-forming tube 24 catches the second pass of the yarn "Y." Note at this point the first loop formed by the swing arm 12 still resides over the loop-forming tube 24. As is shown in FIG. 16, the hook 29 with the yarn "Y" therein is withdrawn into the loop-forming tube 24. The swing arm 27 and the package "P" both rotate, the rotation of the package "P" giving back yarn sufficient to form the slip-knot.

The loop-forming tube 14 itself is then retracted, allowing the first loop formed by the swing arm 27 to slide off the end of the loop-forming tube 24 and across the neck of the loop drawn into the loop-forming tube 24 by the hook 29. See FIGS. 16 and 17.

Figure 17:
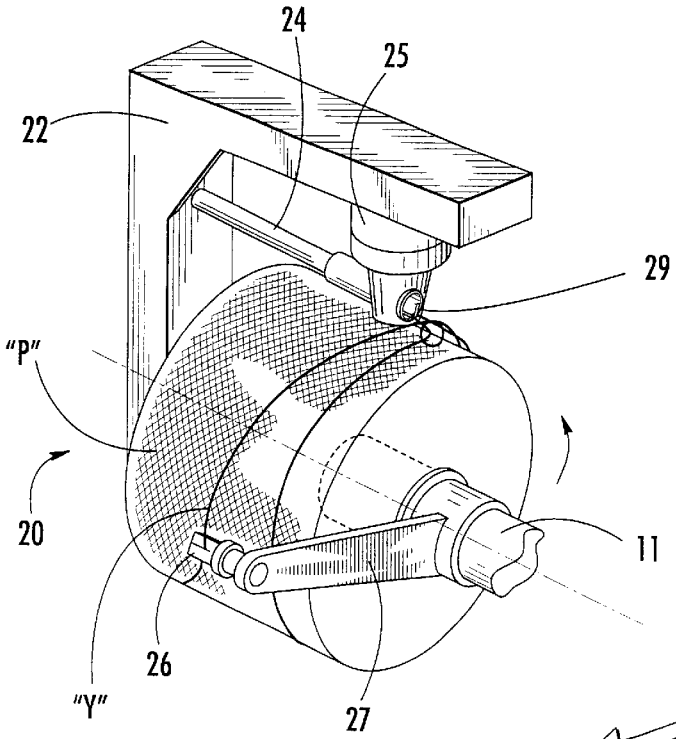
Figure 18:
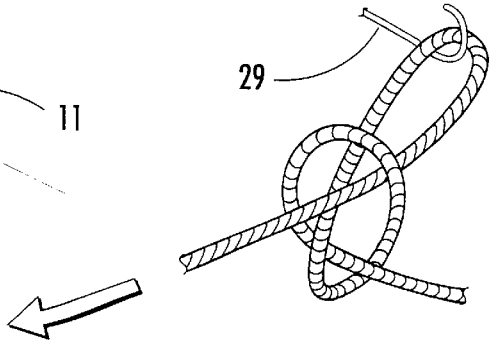
Figure 19:
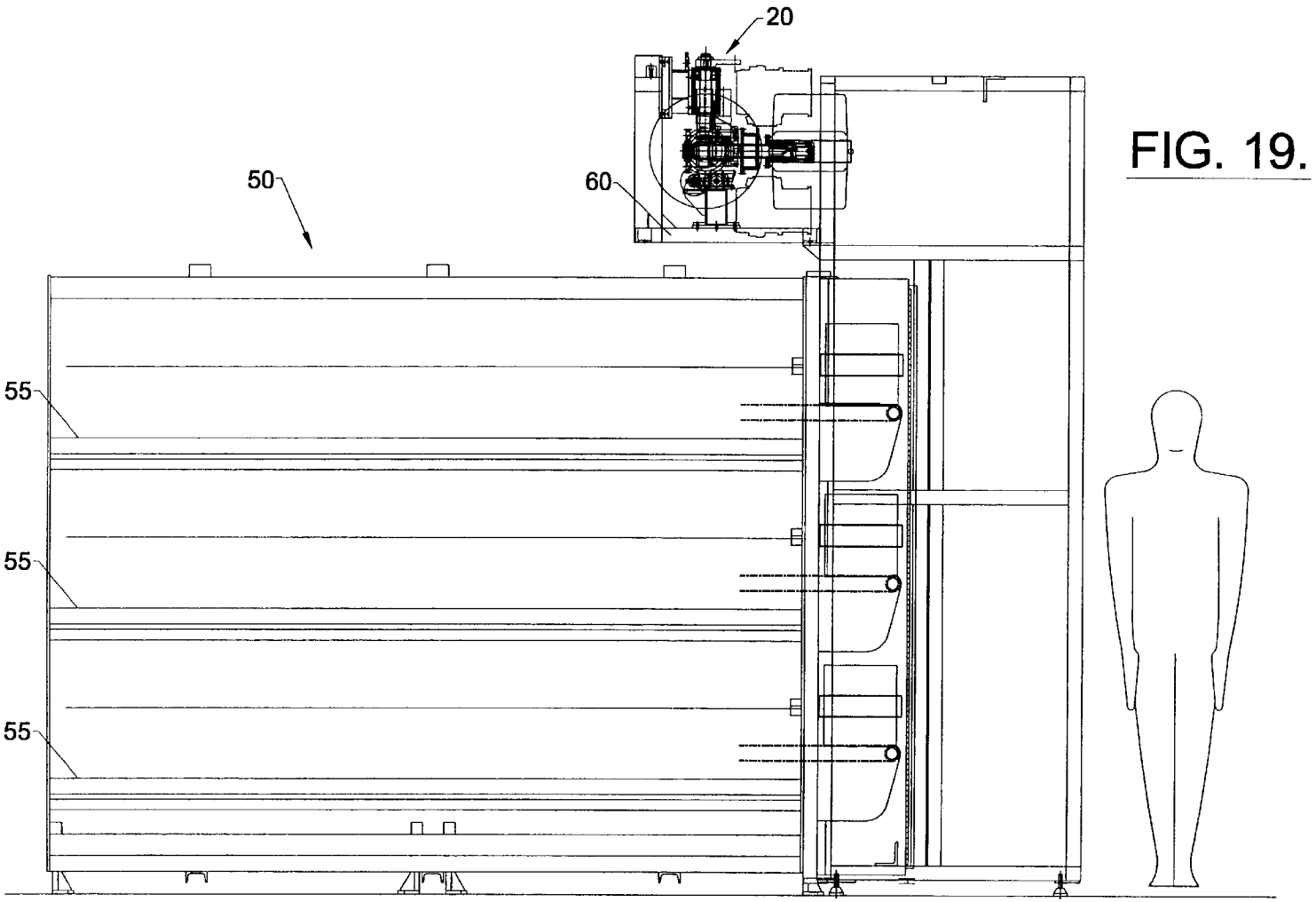
FIG. 19 is a front schematic elevation of a winder, showing the package knotter and related assemblies positioned on top of the winder.
Figure 20:
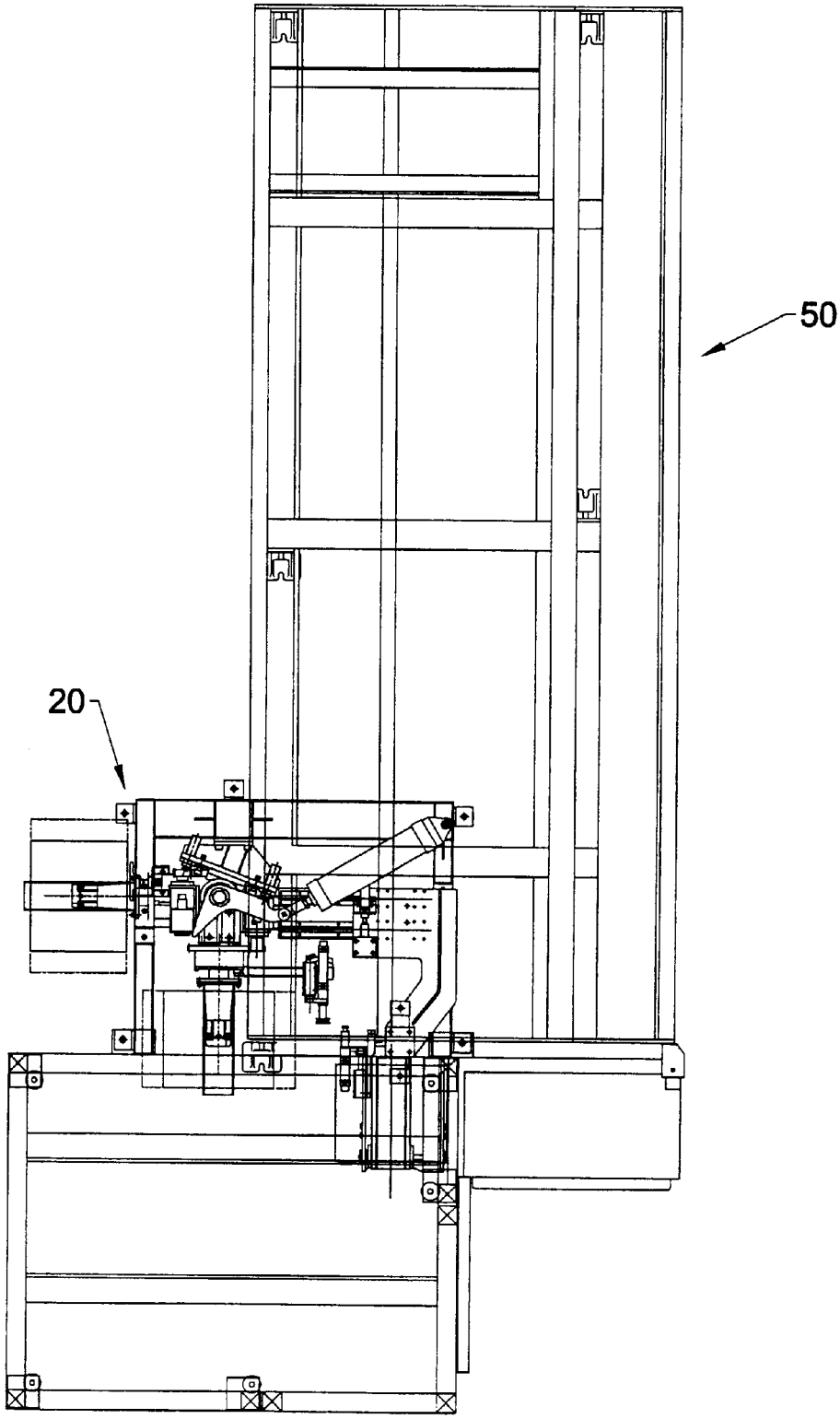
FIG. 20 is a top plan schematic view of the winder and package knotter shown in FIG. 19.
Figure 21:
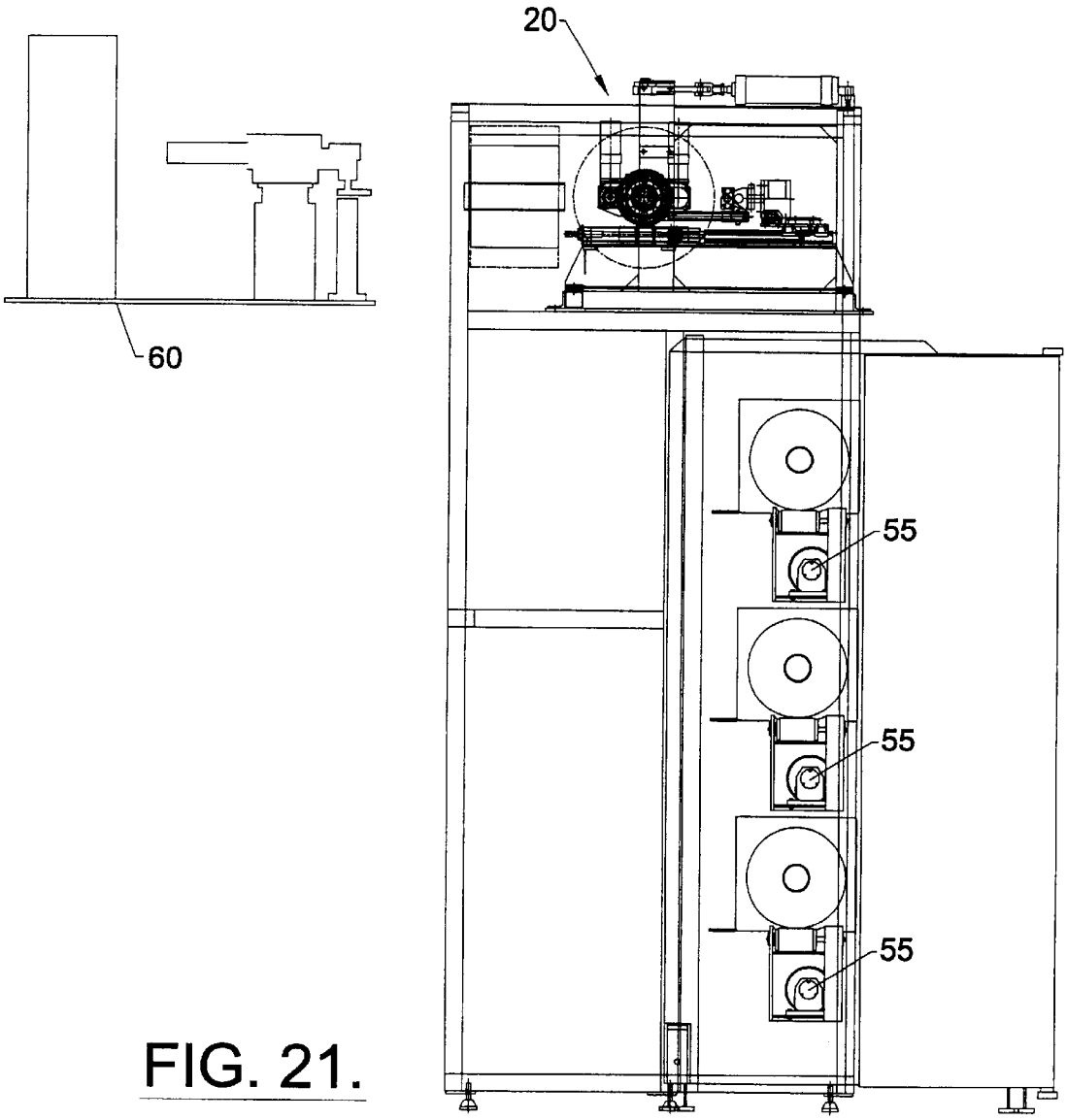
FIG. 21 is an end schematic view of the winder and package knotter shown in FIG. 19.
Figure 22:
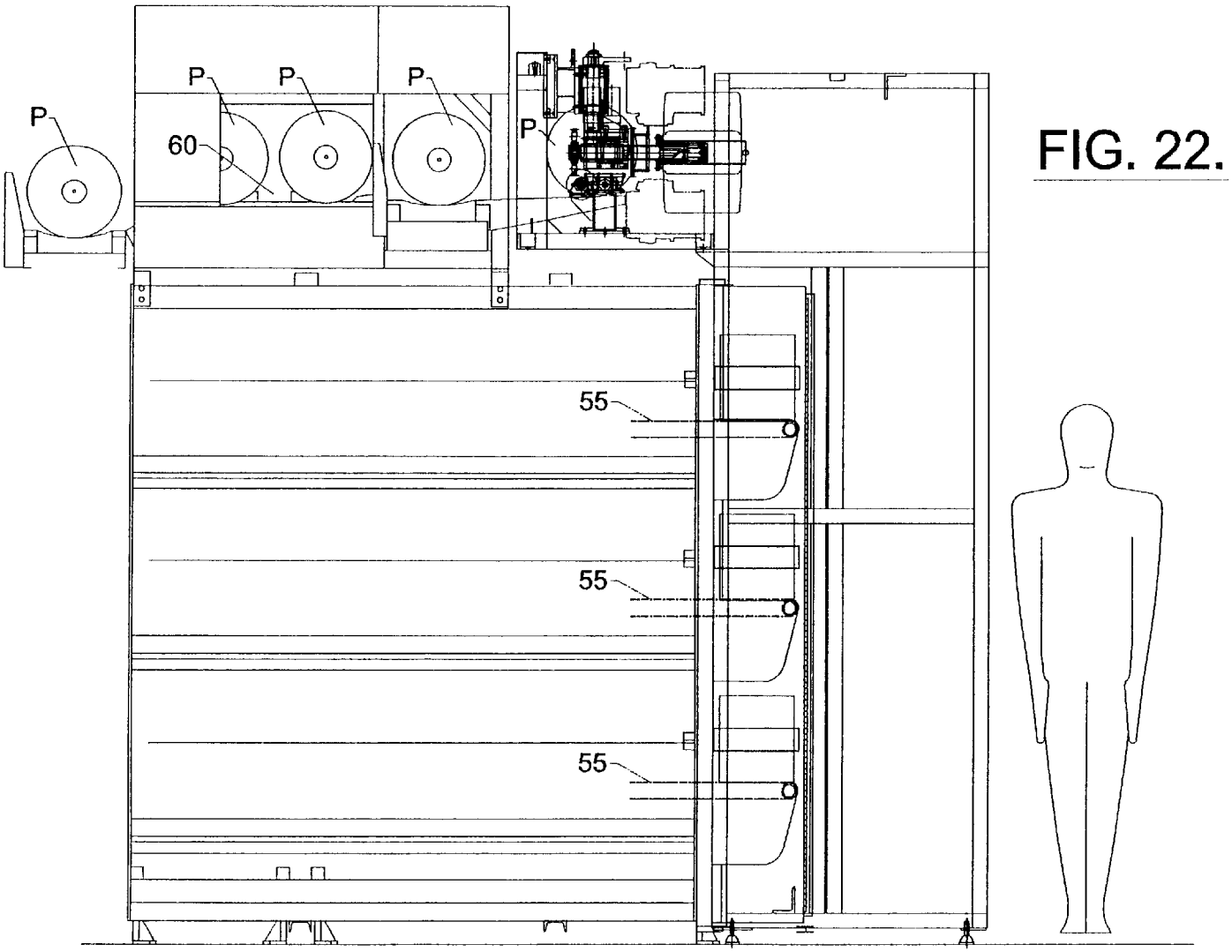
FIG. 22 is a front elevation of a shortened prototype winder showing the package knotter and the package conveyer from the package knotter to the packing station.

Referring now to FIGS. 17 and 18, the knot is tightened by rotating the package "P" in the wind direction sufficiently to pull the loop tight around the length of yarn "Y" being retained in the loop-forming tube by the hook 29. The hook 29 releases the yarn "Y" and the slip-knot is fully formed. See FIG. 18. The package "P" is rotated sufficiently to snug the yarn "Y" around the outside of the package "P" and then transported away from the automatic knot-tying machine 20.

In both embodiments, the knot is released and the yarn tail made available for being tied to another end of yarn merely by grasping the free end and pulling gently.

After insertion of the knot, the package is rotated 90 degrees and a label is inserted into the interior of the package. One such suitable labeling machine sold under the trademark "Pneu Touch" and made by PTI, Inc. Aspects of this device are disclosed in U.S. Pat. Nos. 5,435,862 and 5,540,795.

Referring now to FIGS. 19–22, the knot-tying machine 20 is shown in place on a winder, generally identified at reference numeral 50, which may be any type of textile winder, for example those manufactured by applicant and used principally for processing carpet yarn. Winder 50 winds yarn onto a plurality of packages, for example 24, during a single winding phase, after which the packages are doffed, and new, empty packages are donned and the winding process begins again. After doffing, the packages are conveyed on a conveyor assembly 55 to one end of the winder 50, where they are conveyed upwardly to the knot-tying machine 20, which is mounted above the top level of the winder 50. The packages "P" are donned onto the mandrel 21 one at a time and the knotting process described above is carried out. Each package "P" is then doffed from the mandrel 21 and conveyed downstream on a conveyor 60 to a holding station where an entire case of packages "P" is accumulated. See FIG. 22.

Then, the entire case of packages is sent at one time to packing. The entire process is sufficiently rapid that the knotter can process an entire doff of, for example, 36 to 48 packages, while yarn is being wound onto the next batch of packages.

An automatic knot-tying machine and process are described above. Various details of the invention may be changed without departing from its scope. Furthermore, the foregoing description of the preferred embodiment of the invention and the best mode for practicing the invention are provided for the purpose of illustration only and not for the purpose of limitation.

We claim:

1. A knot-tying machine, comprising:

(a) a package support for holding a package having a supply of textile yarn with an exposed free end wound onto an outer surface of the package;

(b) a yarn gripper for releasably gripping and holding a length of the yarn adjacent the exposed free end of the yarn;

(c) a loop-forming assembly mounted for rotational movement relative to the package support for forming a loop in the length of the yarn adjacent the exposed free end of the yarn and extending circumferentially around the outer surface of the package;

(d) a knot-forming assembly for forming a slip-knot in the loop of the yarn formed by the loop-forming assembly, the slip-knot being adapted to be subsequently removed when desired by pulling on the free end of the yarn.

2. A knot-tying machine according to claim 1, wherein said package support is stationarily mounted and said loop-forming assembly is mounted for rotation around the periphery of the package support for capturing the length of the yarn adjacent the exposed free end of the yarn for forming a loop therein.

3. A knot-tying machine according to claim 1, wherein:

(a) said loop-forming assembly is stationarily mounted;

(b) said package support is mounted for rotation about an axis which is stationary relative to said loop-forming assembly;

(c) said gripper is mounted concentrically with said package support for rotation therewith; and (d) said knot-forming assembly is mounted for rotation about an axis perpendicular to the axis of the loop formed by the loop-forming assembly for inserting the knot in the loop.

4. A knot-tying machine according to claim 1, wherein said knot-forming assembly includes:

(a) an elongate member movable between:

(i) a retracted position;

(ii) an extended position within the loop formed by the loop-forming assembly; and (iii) a secondary loop-forming position wherein said elongate member is mounted on a pivot for rotation to form a secondary loop in said loop;

and further wherein said knot-forming assembly includes a yarn capture assembly carried by said elongate member for capturing a length of the yarn between the loop and the gripper and pulling said length of yarn through the secondary loop to form the slip knot.

5. A knot-tying machine according to claim 4, wherein the elongate member of the knot-tying assembly is mounted for rotation on an axis perpendicular to the axis of rotation of the package.

6. A knot-tying machine according to claim 5, wherein said elongate member comprises a hollow tube, and wherein said yarn capture assembly includes a hook movable between a retracted position within said elongate member and an extended position in a yarn capture position relative to said yarn.

7. A knot-tying machine, comprising:

(a) a stationary yarn package support for holding a package having a supply of textile yarn wound thereon with an exposed free end residing on an outer surface of the package;

(b) a stationary yarn gripper for releasably gripping and holding a length of the yarn adjacent the exposed free end of the yarn;

(c) a loop-forming swing arm for forming a loop in the length of the yarn adjacent the exposed free end of the yarn and intermediate the gripper and the package, said loop-forming swing arm mounted for rotation about an axis parallel to a longitudinal axis of the package in spaced-apart relation to the outer surface of the package and intermediate the surface of the package and the yarn gripper for separating a length of yarn from the surface of the package;

(d) said loop-forming swing arm including thereon a tubular elongate member mounted on said loop-forming swing arm for twisting the length of yarn separated from the surface of the package and held by the gripper about an axis perpendicular to the axis of rotation of the loop-forming swing arm for forming a secondary loop therein;

(e) a knot-forming assembly carried in the interior of by said elongate member for capturing a second length of the yarn separated from the surface of the package and pulling the second length of yarn through the secondary loop and thus forming a slip-knot in the loop of the yarn formed by the loop-forming assembly adjacent the free end thereof, the slip-knot being adapted to be subsequently removed when desired by pulling on the free end of the yarn, wherein said knot-forming assembly is selectively movable in and out of said elongate member.

8. A knot-tying machine according to claims 1, 2, 3, 4, 5, 6 or 7, and including:

(a) a textile winder having a plurality of winding stations for winding yarn onto yarn packages; and (b) a conveyor assembly for conveying yarn packages from the winding stations to the knot-tying machine.

9. A knot-tying machine according to claim 8, and including a second conveyor assembly for conveying yarn packages with the slip-knot formed thereon to a remote location for packaging.

10. A method of tying a knot in a yarn carried on a package, comprising the steps of:

(a) mounting a package onto a package support, said package having a supply of a yarn material with an exposed free end wound onto an outer surface of the package;

(b) gripping and holding a length of the yarn adjacent the exposed free end of the yarn;

(c) forming a loop in the length of the yarn adjacent the exposed free end of the yarn and intermediate the gripper and the package by relative rotational movement of the package and a loop-forming assembly, wherein said loop-forming assembly comprises a tubular elongate member mounted on a loop-forming swing arm and rotatable about an axis perpendicular to the axis of rotation of said package;

(d) forming a slip-knot in the loop of the yarn formed in the yarn of a type adapted to be subsequently removed when desired by pulling on the free end of the yarn.

11. A method of tying a knot according to claim 10, wherein the step of forming the loop comprises the step of rotating a loop-forming assembly about an axis of rotation of the package in spaced-part relation thereto for capturing and separating a length of the yarn from the surface of the package.

12. A method of tying a knot according to claim 10, and including the steps of:

(a) mounting a loop-forming assembly in stationary relation to said package;

(b) mounting the package for rotation about an axis which is stationary relative to said loop-forming assembly;

(c) providing a gripper mounted concentrically with said package support for rotation therewith; and (d) rotating a knot-forming assembly relative to the loop formed by the loop-forming assembly for inserting the knot in the loop.

13. A method of tying a knot according to claim 10, wherein said step of forming the loop includes the steps of:

(a) moving an elongate member movable between:

(i) a retracted position;

(ii) an extended position within the loop formed by the loop-forming assembly;

(iii) a secondary loop-forming position wherein said elongate member is mounted on a pivot for rotation to form a secondary loop in said loop;

(b) providing a yarn capture assembly carried by said elongate member; and (c) capturing a length of the yarn between the loop and the gripper and pulling said length of yarn through the secondary loop to form the slip knot.

14. A method of tying a knot according to claim 13, and including the step of mounting the elongate member of the knot-tying assembly for rotation on an axis perpendicular to the axis of rotation of the package.

15. A method of tying a knot according to claim 14, wherein said elongate member includes a hook carried therein and movable between a retracted position within said hollow tube and an extended position in a yarn capture position relative to said yarn.

* * * * *